US010662971B2

(12) United States Patent
Krahn

(10) Patent No.: US 10,662,971 B2
(45) Date of Patent: May 26, 2020

(54) PHI FAN

(71) Applicant: Gilbert H. Krahn, Rockford, IL (US)

(72) Inventor: Gilbert H. Krahn, Rockford, IL (US)

( * ) Notice: Subject to any disclaimer, the term of this patent is extended or adjusted under 35 U.S.C. 154(b) by 0 days.

(21) Appl. No.: 16/503,991

(22) Filed: Jul. 5, 2019

(65) Prior Publication Data

US 2020/0011344 A1 Jan. 9, 2020

Related U.S. Application Data

(60) Provisional application No. 62/694,371, filed on Jul. 5, 2018.

(51) Int. Cl.
*F04D 29/30* (2006.01)
*F01D 5/14* (2006.01)
*F04D 17/06* (2006.01)

(52) U.S. Cl.
CPC ..... *F04D 29/30* (2013.01); *F01D 5/141* (2013.01); *F04D 17/06* (2013.01); *F05B 2250/15* (2013.01); *F05D 2200/30* (2013.01)

(58) Field of Classification Search
None
See application file for complete search history.

(56) References Cited

U.S. PATENT DOCUMENTS 4,364,712 A * 12/1982 Charles ..... F04D 29/326 416/183
7,083,387 B2 * 8/2006 Chen ..... F04D 29/325 416/189
7,673,834 B2 * 3/2010 Harman ..... B64C 23/06 244/199.1
9,328,717 B1 * 5/2016 Walker ..... F03D 3/005
2017/0350254 A1 * 12/2017 Castro ..... F01D 5/023

* cited by examiner

*Primary Examiner* — Igor Kershteyn
*Assistant Examiner* — Jason G Davis
(74) *Attorney, Agent, or Firm* — Reinhart Boerner Van Deuren P.C.

(57) ABSTRACT

A fluid displacement device including a center shaft and a plurality of vanes. Each of the plurality of vanes has an inner edge, an outer edge, and a spiraling edge disposed between the inner edge and the outer edge. The spiraling edge of each of the plurality of vanes follows a Fibonacci spiral based on circular arcs traced through a Fibonacci tiling comprising squares having side lengths that are a multiple of at least five successive Fibonacci numbers.

16 Claims, 16 Drawing Sheets

PHI FAN

CROSS-REFERENCE TO RELATED PATENT APPLICATIONS

This patent application claims the benefit of U.S. Provisional Patent Application No. 62/694,371, filed Jul. 5, 2018, the entire teachings and disclosure of which are incorporated herein by reference thereto.

FIELD OF THE INVENTION

This invention generally relates to fluid displacement devices.

BACKGROUND OF THE INVENTION

Various devices, such as pumps, compressors, fans, aircraft, etc., are designed to displace a fluid. Such devices include vanes, impellers, propellers, augers, etc. in order to accomplish this goal. The efficiency of these devices can be improved by providing an element that is able to displace a greater volume of fluid per rotation or that is able to deflect more incoming fluid when held stationary. Various embodiments of such an element are disclosed herein.

BRIEF SUMMARY OF THE INVENTION

Embodiments of a fluid displacement device including a center shaft and a plurality of vanes are disclosed herein. Each of the plurality of vanes has an inner edge, an outer edge, and a spiraling edge disposed between the inner edge and the outer edge. The spiraling edge of each of the plurality of vanes follows a Fibonacci spiral based on circular arcs traced through a Fibonacci tiling comprising squares having side lengths that are a multiple of at least five successive Fibonacci numbers.

In embodiments, the plurality of vanes includes from two to five vanes. Further, in embodiments, the outer edges of the plurality of vanes are substantially equidistantly spaced around the center shaft. For example, the plurality of vanes may be two vanes having outer edges separated by about 180°. In another example, the plurality of vanes is three vanes having outer edges that are separated by about 120°. In still another example, the plurality of vanes is four vanes having outer edges that are separated by about 90°. In yet another example, the plurality of vanes is five vanes having outer edges that are separated by about 72°.

In embodiments, the at least five successive Fibonacci numbers are 1, 1, 2, 3, 5. Further, in embodiments, the at least five successive Fibonacci numbers includes at least six Fibonacci numbers. In such embodiments, the at least six Fibonacci numbers may be 1, 1, 2, 3, 5, 8.

In embodiments, the center shaft has a first end and a second end defining a length of the center shaft therebetween, and the length is from 10 to 20 times the side length of a first square of the Fibonacci tiling. In particular embodiments, the length is from 13 to 17 times the side length of the first square of the Fibonacci tiling. In embodiments, the center shaft has a radius that is at most equal to the side length of a first square of the Fibonacci tiling.

Further, in embodiments, the spiraling edge descends from the first end of the center shaft towards the second end of the center shaft to a position along the length of the center shaft that is from 30% to 70% of the length of the center shaft. More particularly, the position along the length of the center shaft may be from 40% to 60% of the length of the center shaft.

The center shaft may define an axis, and the plurality of vanes are bounded by arcs of a vesica piscis in which intersections of the arcs of the vesica piscis are located on the axis. In such embodiments, the vesica piscis has a width that is perpendicular to the axis of the center shaft, and the width of the vesica piscis is from 12 to 22 times the side length of a first square of the Fibonacci tiling. More particularly, the width of the vesica picis is from 15 to 20 times the side length of the first square of the Fibonacci tiling.

In embodiments, the fluid displacement device also includes a reinforcing ring encircling the plurality of vanes.

In embodiments, the center shaft is configured to rotate to spin the plurality of vanes. In such an embodiment, the fluid displacement device is configured to redirect inlet fluid flow transverse to a longitudinal axis of the center shaft to outlet fluid flow substantially parallel to the longitudinal axis.

In other embodiments, the center shaft is stationary. In such embodiments, the fluid displacement device is configured to redirect inlet fluid flow entering the vanes from a direction parallel to a longitudinal axis of the center shaft to outlet fluid flow radially outward from the plurality of vanes.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

As disclosed herein, embodiments of a fluid displacement device designed based on the Phi ratio and Fibonacci spiral are provided. The fluid displacement device may be used in a variety of contexts, such as a fan, an impeller, a propeller, an auger, or a mixer, among others. The size and shape of the fluid displacement device is based on the Phi ratio, and thus, the fluid displacement device may be referred to as a "phi fan." As compared to other available products, the design is more closely aligned to the Phi ratio in its geometry, more unique in its simplicity, provides greater displacement, is more easily adaptable to more than two blades, and is more versatile. These and other aspects and advantages will be discussed herein in relation to the exemplary embodiments. This discussion should be viewed as illustrative and not limiting.

Figure 1A:
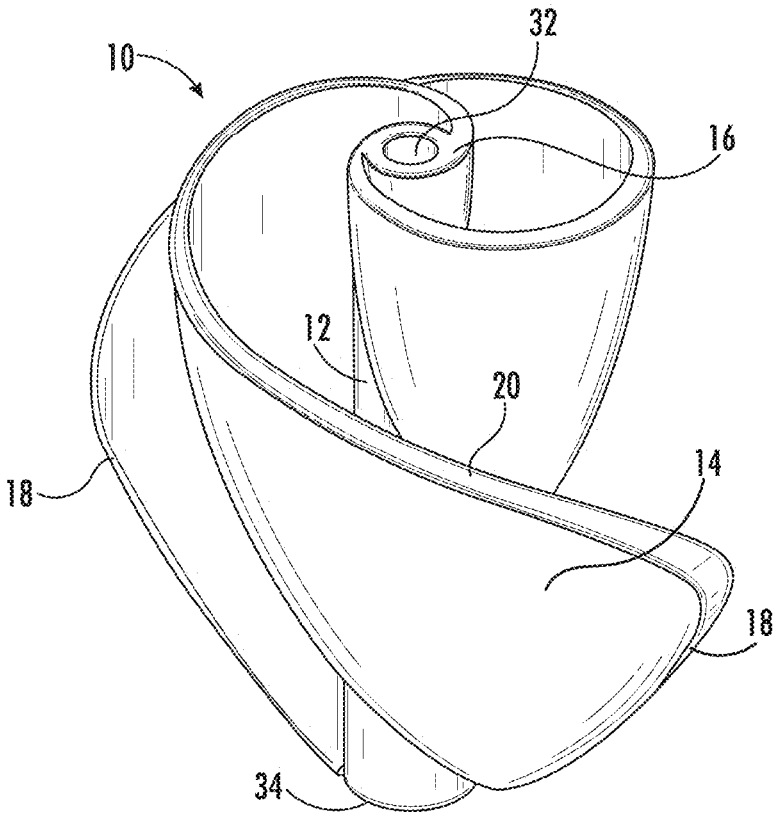
FIGS. 1A-1D depict an embodiment of a fluid displacement device with geometrical relationships between elements shown, according to an exemplary embodiment.

FIG. 1A depicts a perspective view of a fluid displacement device 10 according to an exemplary embodiment. As can be seen in FIG. 1A, the fluid displacement device 10 includes a center shaft 12 and a plurality of vanes 14. In the embodiment depicted in FIG. 1A, the plurality of vanes 14 is two vanes. However, in other embodiments (including those depicted in other figures), the fluid displacement device 10 may include more than two vanes 14. In embodiments, the fluid displacement device 10 includes up to ten vanes 14. In the embodiment depicted, the vanes 14 have an inner edge 16 joined to the center shaft 12 and an outer edge 18. A spiraling edge 20 joins the inner edge 16 to the outer edge 18.

Figure 1C:
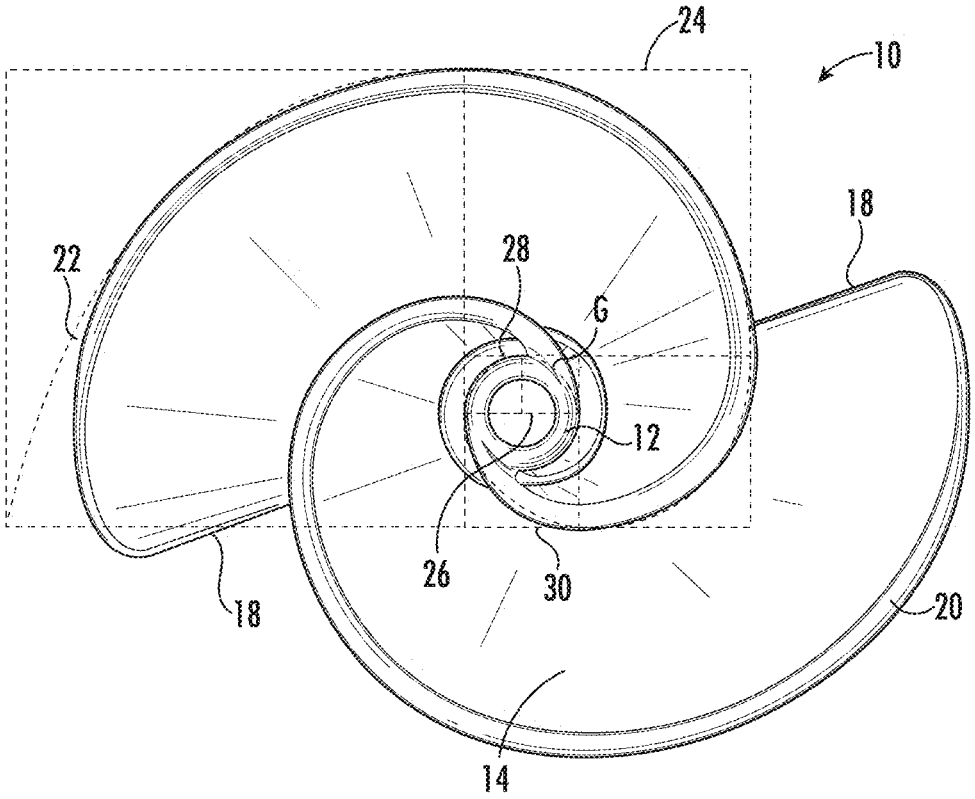
Figure 1B:
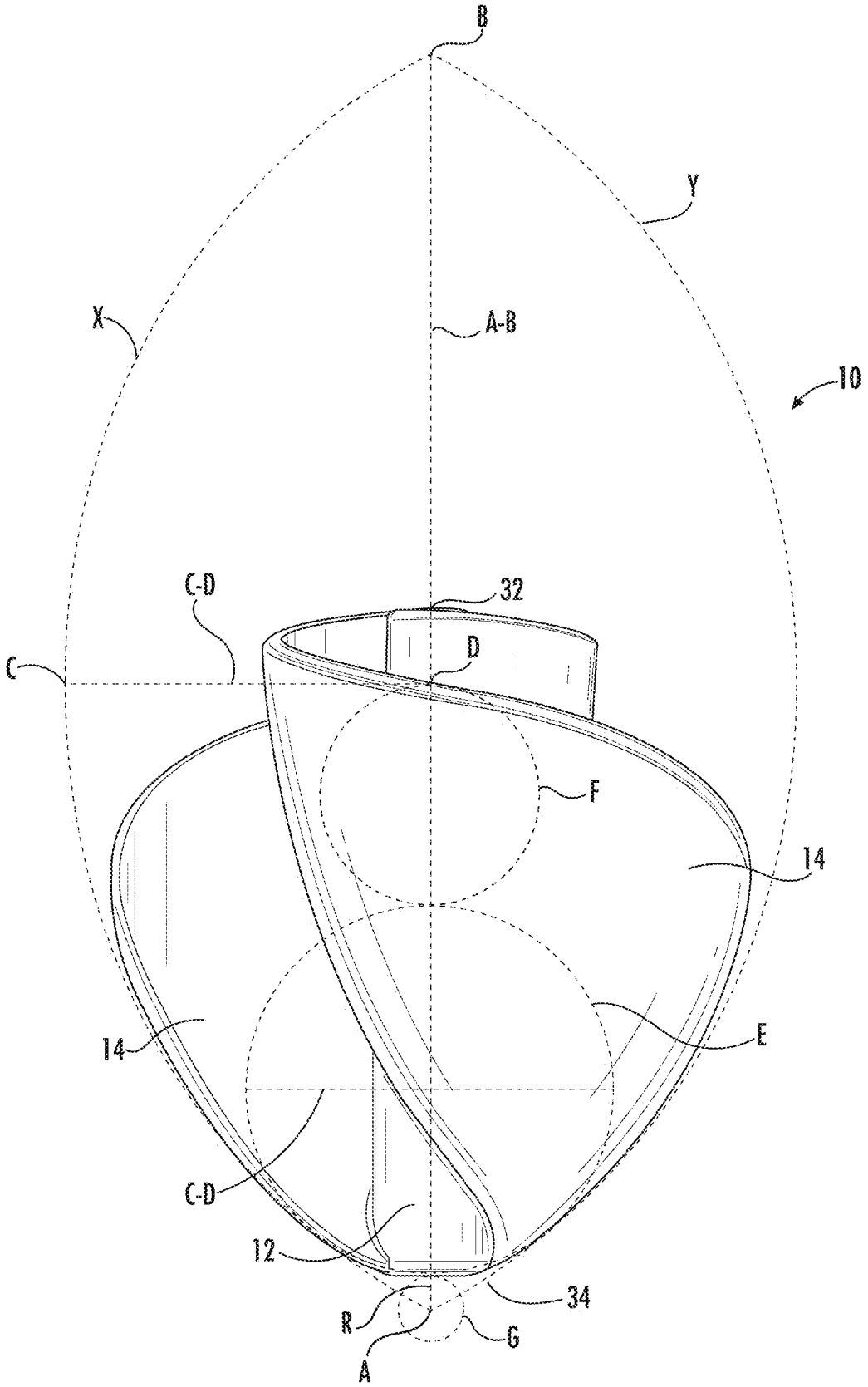

The fluid displacement device 10 of FIG. 1A is shown in a profile view in FIG. 1B. As can be seen in FIG. 1B, the profile of the fluid displacement device 10 is defined by a vesica piscis formed by circles having a radius of 2φ Units. A vesica piscis is formed by the intersection of two equal circles whose centers are offset by a distance equal to the radii of the circles. In FIG. 1B, the vescia piscis is formed by an arc X from the first circle and an arc Y from the second circle. Geometrically, the arc X and arc Y represent ⅓ of the circumference of the circles that formed the vesica piscis.

In FIG. 1B, the bottom of the vesica piscis where arc X and arc Y intersect is referred to as point A, and the top of the vesica piscis where arc X and arc Y intersect is referred to as point B. A line between point A and point B is referred to as line A-B. A midpoint of line A-B is referred to as point D, and a point on arc X of the vesica piscis wherein a tangent is parallel to line A-B is referred to as point C (which also is the center of a reference circle used to form the vesica piscis). A line between point C and point D is referred to as line C-D. The length of line C-D is equal to 1φ Unit. A circle E having a diameter of 1φ Unit is positioned on line A-B such that two points on the circumference of circle E are tangential to arc X and arc Y (i.e., the circle E is internally tangent to arc X and arc Y). Further, a circle F having a diameter of 1 Unit is positioned on line A-B over circle E. As can be seen, circle F has a top point that is tangent to line C-D, i.e., having a point on its circumference coincident with point D.

A further circle G is formed along line A-B and is centered on point A, and a radius R of circle G makes up a portion of the line length of line A-B. Geometrically, line A-B has a length that is equal to the radius of the reference circles (2φ Units) multiplied by √3, and thus, line A-B has a length of 2√3φ Units. Also, from the relationships of circle E, circle F, and circle G, the length of line A-B is 2(1 Unit+1φ Unit+R).

As can be seen in FIG. 1B, the vanes 14 of the fluid displacement device 10 are bounded by arc X and arc Y. In particular, the outer edge 18 of each vane 14 is substantially located on the vesica piscis. In the embodiment of FIG. 1B, the length of the center shaft 12 is equal to the circumference of circle F minus R.

Referring now to FIG. 1C, the curvature of the spiraling edge 20 follows a Fibonacci spiral 22 as shown in the top view of the fluid displacement device 10. In the embodiment of FIG. 1C, the Fibonacci spiral 22 is formed by tracing circular arcs between opposite corners of squares in a Fibonacci tiling 24. The Fibonacci sequence used to generate the Fibonacci spiral 22 and tiling 24 is related to the Phi ratio (φ=1.61803 . . . ) in that the Fibonacci numbers ($F_0$=0, $F_1$=1, . . . $F_n$=$F_{n-1}$+$F_{n-2}$) of the sequence approximate the Phi ratio for $F_n/F_{n-1}$ at large values. However, as shown in FIGS. 1B and 1C, the Fibonnaci spiral 22 is also related to the vesica piscis through circle G. In particular, the radius R of circle G is the side length of a first square 26 of the Fibonacci tiling.

In FIG. 1C, the Fibonacci sequence used was 1, 1, 2, 3, 5, 8. Thus, the first square 26 of the Fibonacci tiling has a side length of 1 unit (i.e., R=1 unit), the second square 28 has a side length of 1 unit, the third square 30 has a side length of 2 units, etc. Using the two relationships for the length of line A-B discussed above, the relationship between "Units" and "units" is found to be 1 unit=(φ√3−φ−1) Units. Further, using the approximations for √3 of 1.732 and for φ of 1.618, 1 unit is equal to 0.184 Units, or 5.423 units is equal to 1 Unit. As used herein, "units" and "Units" are arbitrary and could be any measurement unit (e.g., inches, feet, yards, millimeters, centimeters, meters, etc.). Further, the "units" and "Units" are relative to each other. Thus, if the first square 26 has a side length of 2 inches (1 unit), the third square 30 would have a side length of 4 inches (2 units) and circle F would have a diameter of 10.85 inches (1 Unit).

Having geometrically described the structure fluid displacement device 10, relative measurements of components of the fluid displacement device will now be described. As can be seen in the embodiment depicted in FIG. 1C, the first square 26 and the second square 28 are positioned over the center shaft 12, and thus, the center shaft 12 has a diameter of 2 units. Depending on the size of the fluid displacement device 10, the center shaft 12 have a diameter of at most 2 units in embodiments (i.e., the center shaft 12 may have a diameter smaller than 2 units in some embodiments). Further, in embodiments, the vesica piscis is from 12 units to 22 units wide, more particularly from 15 units to 20 units wide. As mentioned above, circle F has a diameter of 1 Unit, and thus, the circumference of circle F is 1π Unit. Using an approximation for π of 3.142, the length of the center shaft 12 (1π Unit−R) is equal to 2.958 Units or 16.041 units. The embodiment shown in FIGS. 1A-1D is exemplary, and in other embodiments, the length of the center shaft 12 may be different. In embodiments, the center shaft 12 is from 10 units to 20 units in length, more particularly from 13 units to 17 units in length.

In embodiments, the length of the center shaft 12 defines, at least in part, the steepness of the spiraling edge 20. That is, the vertical position along the center shaft 12 of the inner edge 16 is different from and higher than the vertical position along the center shaft 12 of the outer edge 18 (with respect to the orientation of the fluid displacement device shown in FIG. 1D). Thus, the spiraling edge 20 descends from the highest vertical position of the inner edge 16 to the highest vertical position of the outer edge 18. In embodiments, the spiraling edge 20 descends from a first end 32 of the center shaft 12 towards a second end 34 of the center shaft 12 over a length that is 30% to 70% of the length of the center shaft 12, more particularly over a length that is from 40% to 60% of the length of the center shaft 12.

Figure 1D:
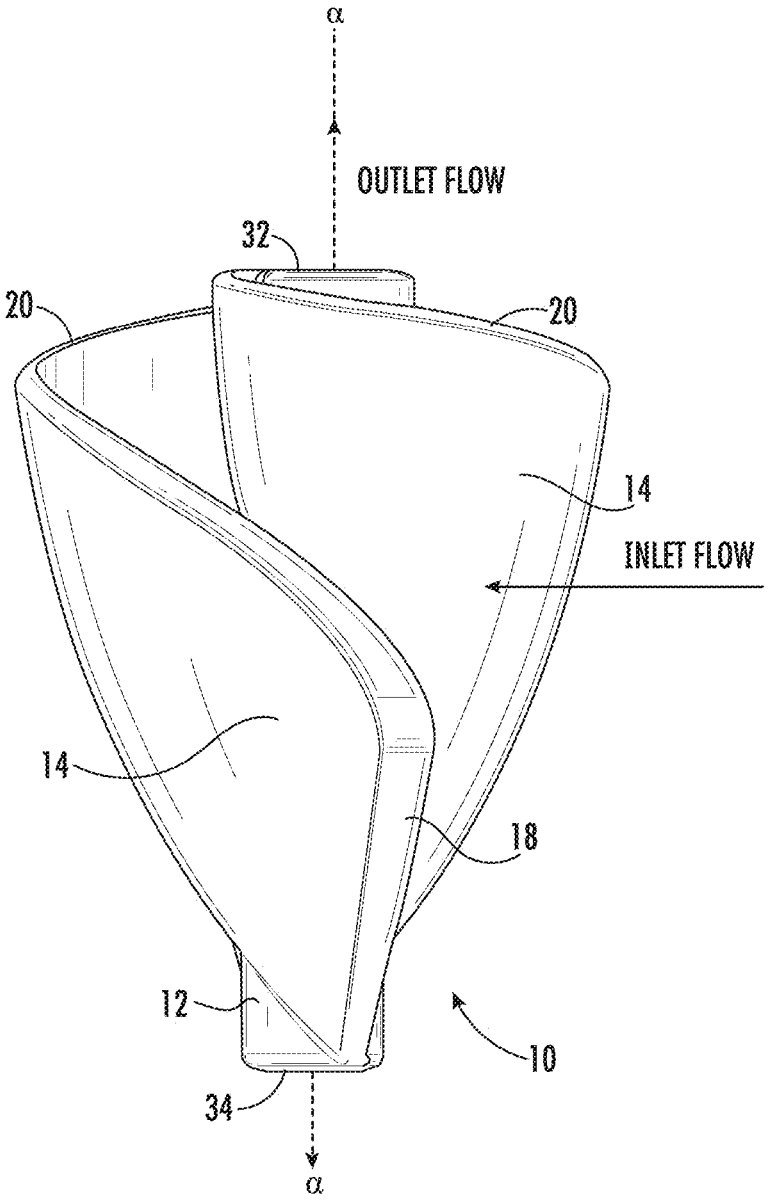

Also referring to FIG. 1D, fluid flow with respect to the fluid displacement device 10 can be seen. As shown in FIG. 1D, fluid entering the fluid displacement device 10 transverse to an axis α of the fluid displacement device 10 exits from the vanes 14 substantially parallel to the axis α of the fluid displacement device 10. Thus, for example, if the center shaft 12 is rotating (e.g., the center shaft 12 is coupled to a motor), then fluid displacement device 10 can be used as a propeller to create thrust or as a fan blade to redirect airflow. In each of the embodiments described herein having a rotatable center shaft 12, the fluid displacement device 10 also has the advantage that fluid entering the vanes 14 from substantially any direction can cause rotation of the fluid displacement device 10 about the center shaft 12.

Figure 2A:
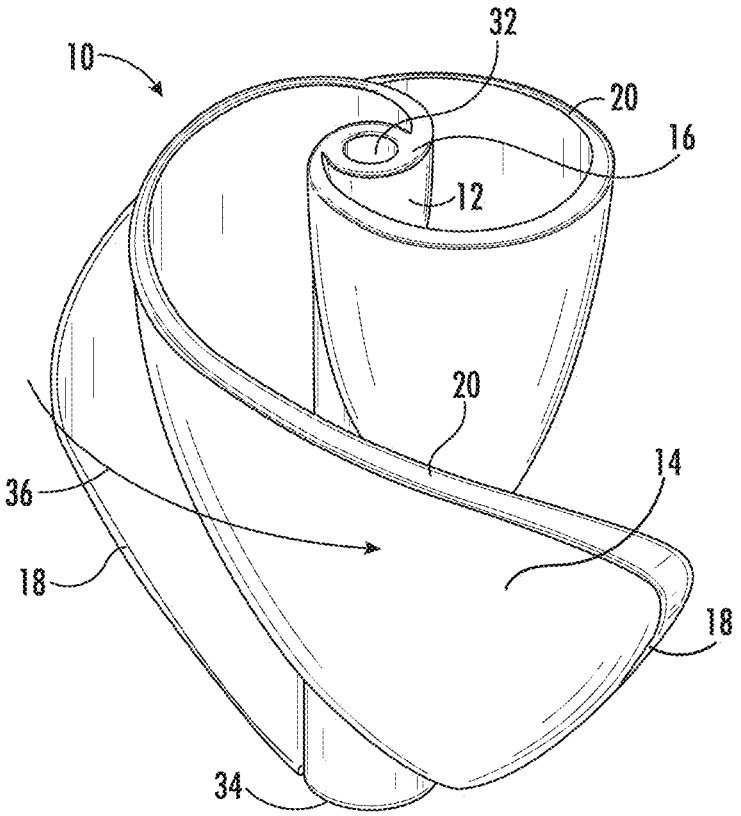
FIGS. 2A-2D depict a two blade embodiment of the fluid displacement device as shown in FIGS. 1A-1D, according to an exemplary embodiment.
Figure 2B:
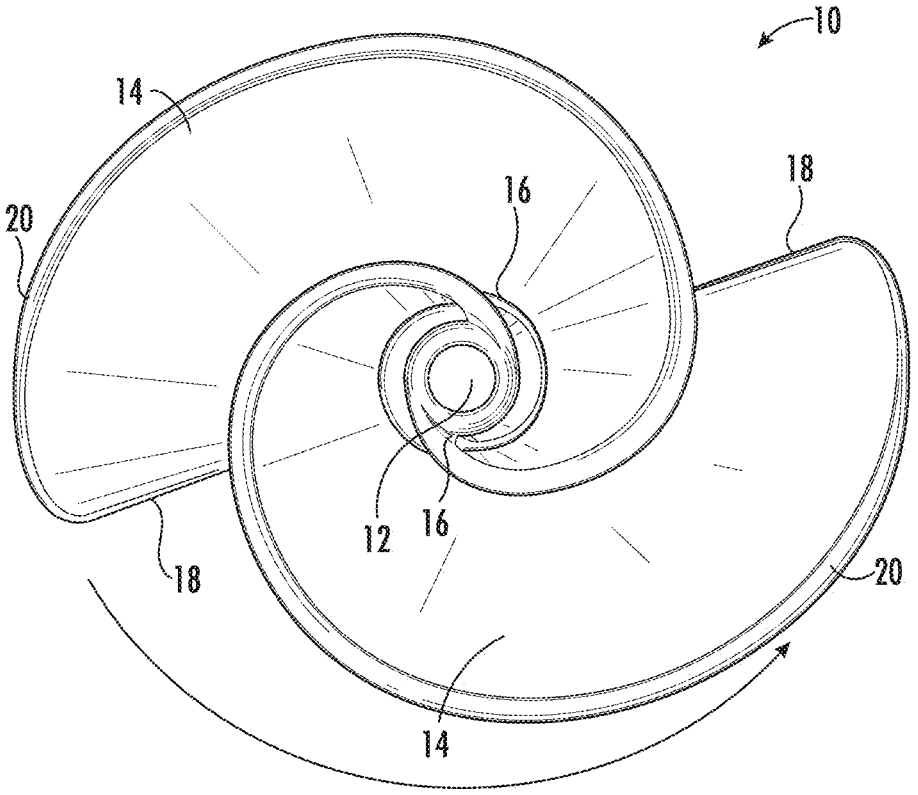
Figure 2C:
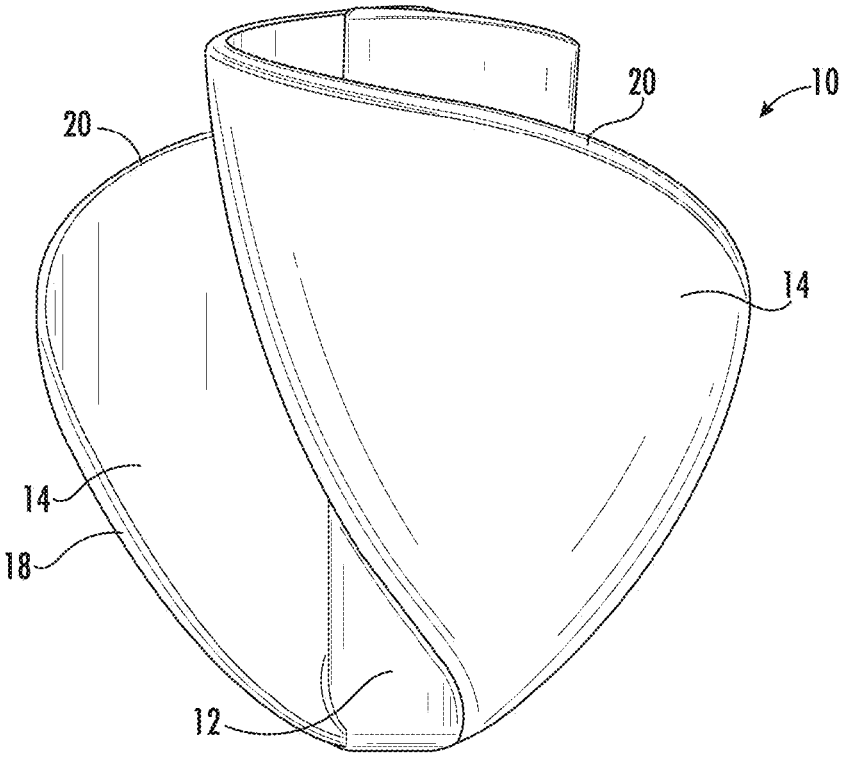
Figure 2D:
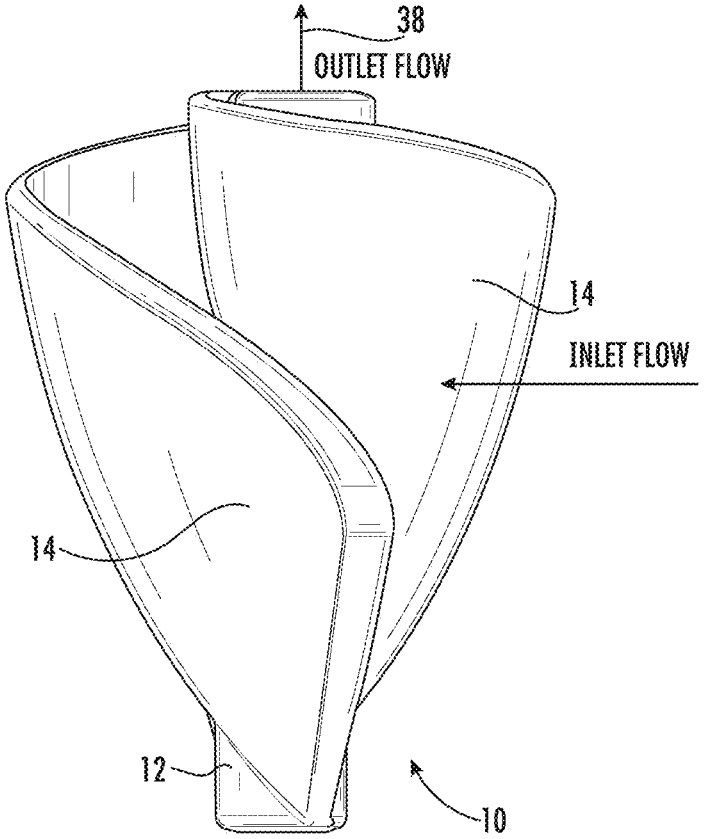

FIGS. 2A-2D depict the fluid displacement device 10 of FIGS. 1A-1D without the overlaid geometric relationships to provide a clear picture of the fluid displacement device 10 itself. As shown in FIG. 2A, the fluid displacement device 10 is shown as rotating about the center shaft 12 in a direction of rotation 36. FIG. 2B depicts a top view of the fluid displacement device 10 of FIG. 2A. As can be seen in the embodiment of FIG. 2B, the outer edges 18 of the vanes 14 are equidistantly spaced around the center shaft 12. That is, the outer edges 18 are separated by about 180°. In embodiments of the fluid displacement device 10, the outer edges 18 of the vanes are substantially equidistantly spaced around the center shaft 12. For example, if the fluid displacement device 10 has three vanes 14, then the outer edges 18 would be separated by about 120°, and if the fluid displacement device 10 has four vanes 14, then the outer edges 18 would be separated by about 90°, etc. FIG. 2C depicts the profile view of the fluid displacement device 10 similar to what is shown in FIG. 1C but without the geometric relationships overlaid. FIG. 2D depicts fluid flow in relation to the fluid displacement device 10, similar to what is shown in FIG. 1D.

Figure 3A:
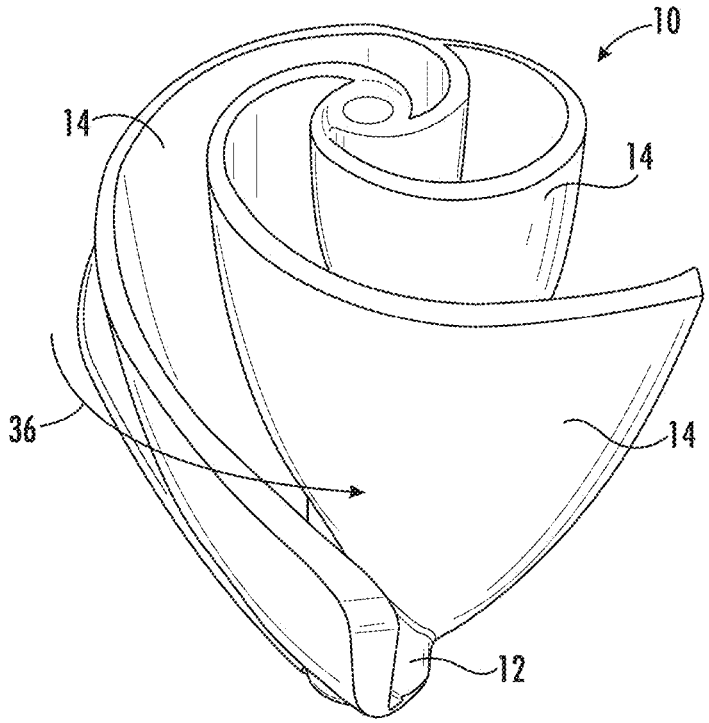
FIGS. 3A-3D depicts a three blade embodiment of the fluid displacement device, according to an exemplary embodiment.
Figure 3B:
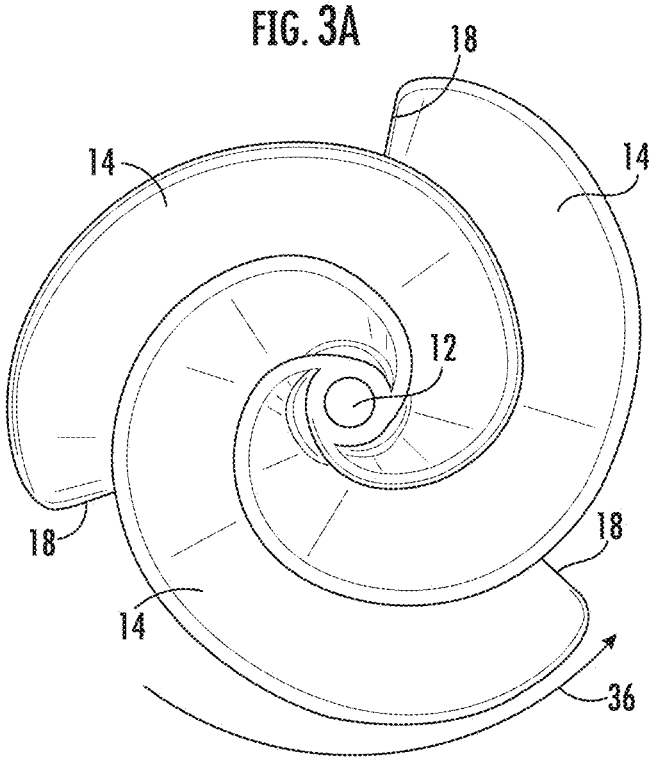
Figure 3C:
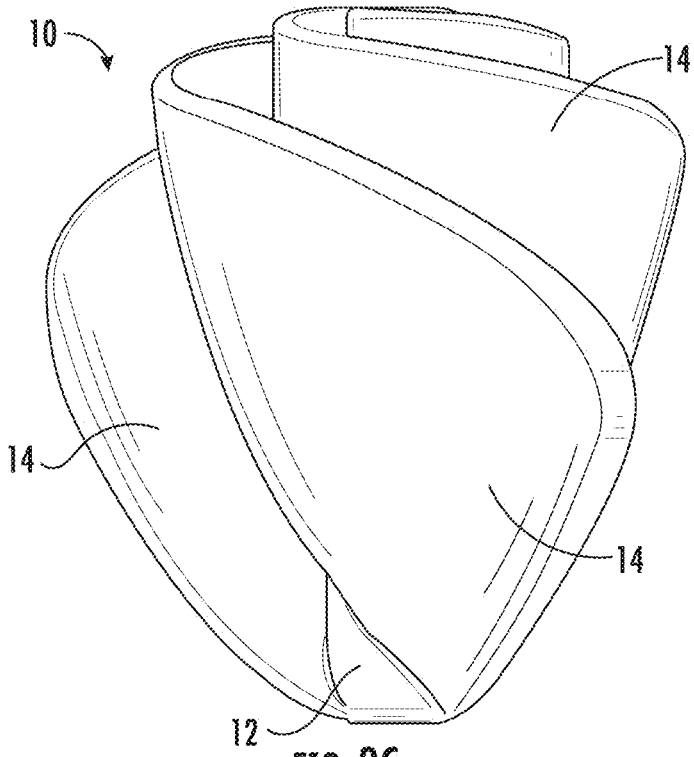
Figure 3D:
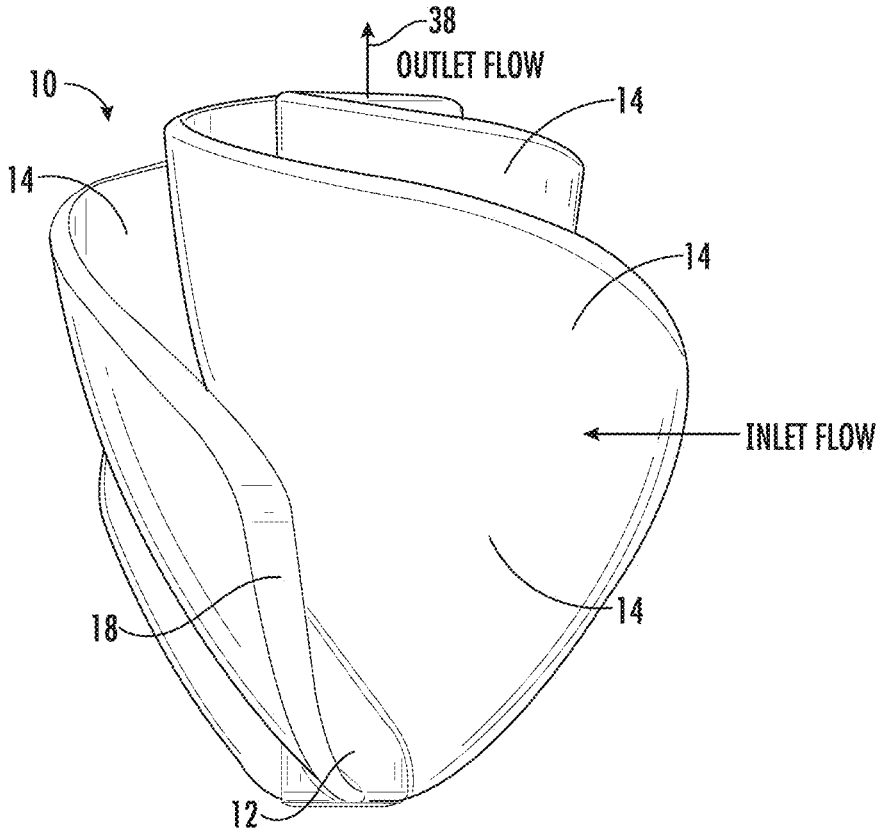

FIGS. 3A-3D depict a fluid displacement device 10 having three vanes 14. As shown in FIG. 3A, the fluid displacement device 10 is shown as rotating about the center shaft 12 in a direction of rotation 36. FIG. 3B depicts a top view of the fluid displacement device 10 of FIG. 3A. As can be seen in the embodiment of FIG. 3B, the outer edges 18 of the vanes 14 are equidistantly spaced around the center shaft 12. That is, the outer edges 18 are separated by about 120°. FIG. 3C depicts the profile view of the fluid displacement device 10, and FIG. 3D depicts fluid flow in relation to the fluid displacement device 10.

Figure 4A:
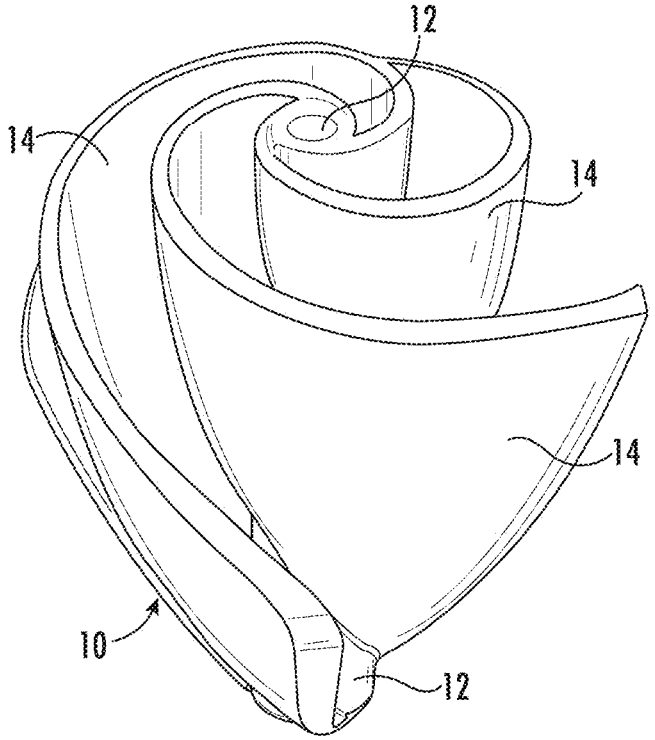
FIGS. 4A-4D depict a three blade embodiment of a fluid displacement device configured to deflect incoming air while being held stationary, according to an exemplary embodiment.
Figure 4B:
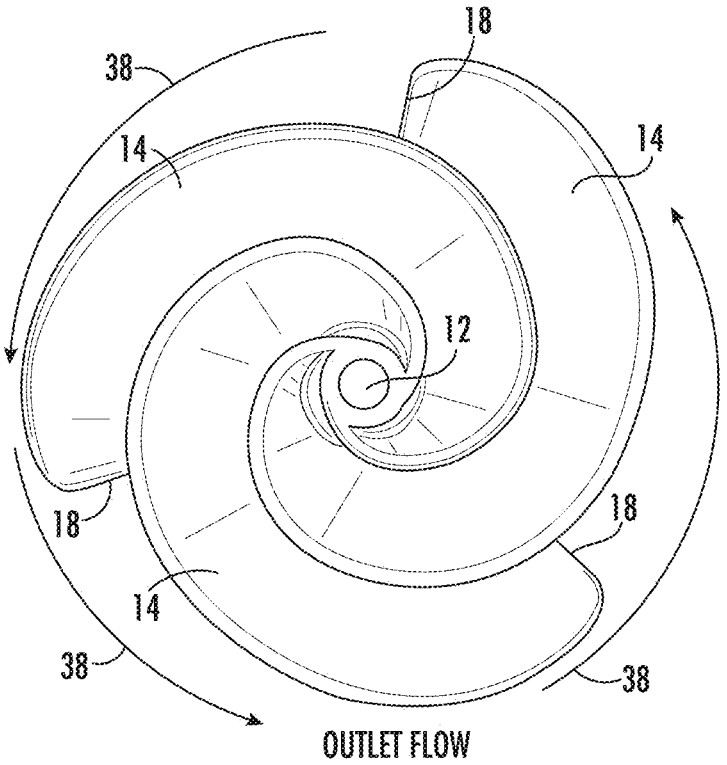
Figure 4C:
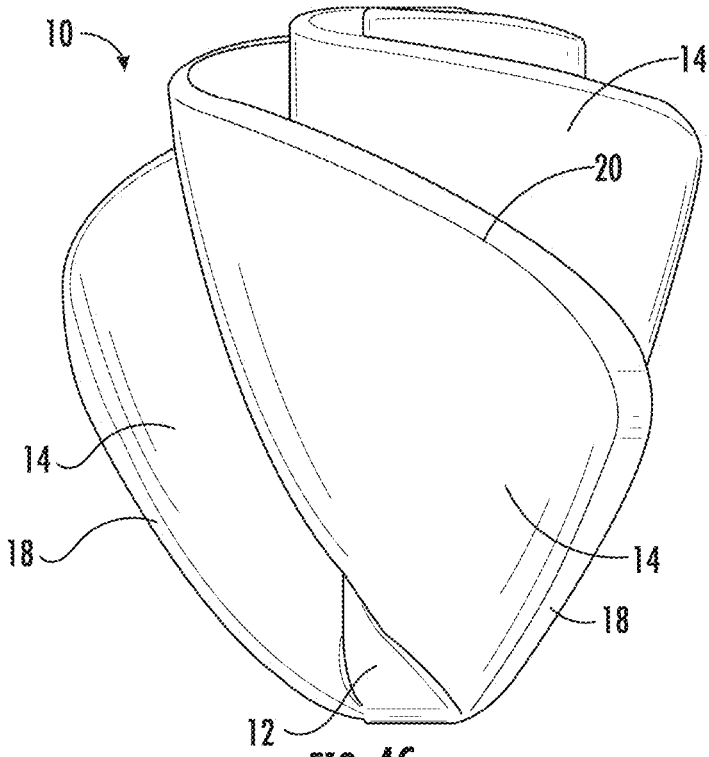
Figure 4D:
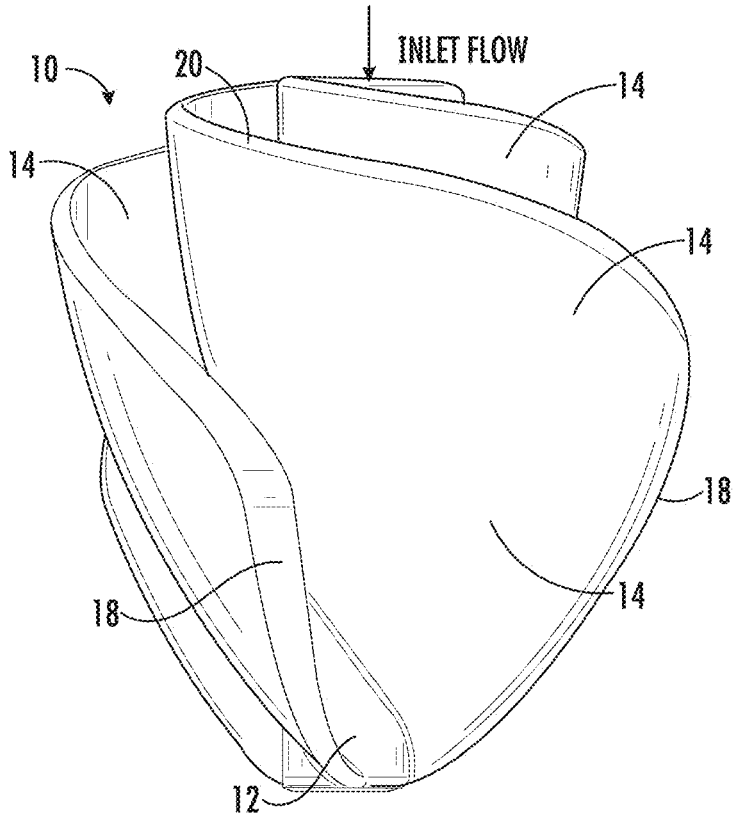

FIGS. 4A-4D depict the fluid displacement device of FIGS. 3A-3D. FIGS. 4A-4D illustrate fluid flow in relation to a stationary (i.e., non-rotating) center shaft 12. As shown in FIGS. 4A and 4C, the fluid displacement device 10 is substantially identical to the fluid displacement device of FIGS. 3A-3D. FIG. 4D depicts fluid flow entering along the axis α, and FIG. 4B depicts the outlet flow 38 from the vanes 14. As can be seen in FIG. 2B, the fluid flow is directed radially outward from the vanes 14. Thus, with the fluid displacement device 10 in a fixed position and having flow along its axis α, the inlet flow is dispersed around the periphery of the fluid displacement device 10 converting a linear or turbulent flow to a smooth swirling flow.

Figure 5A:
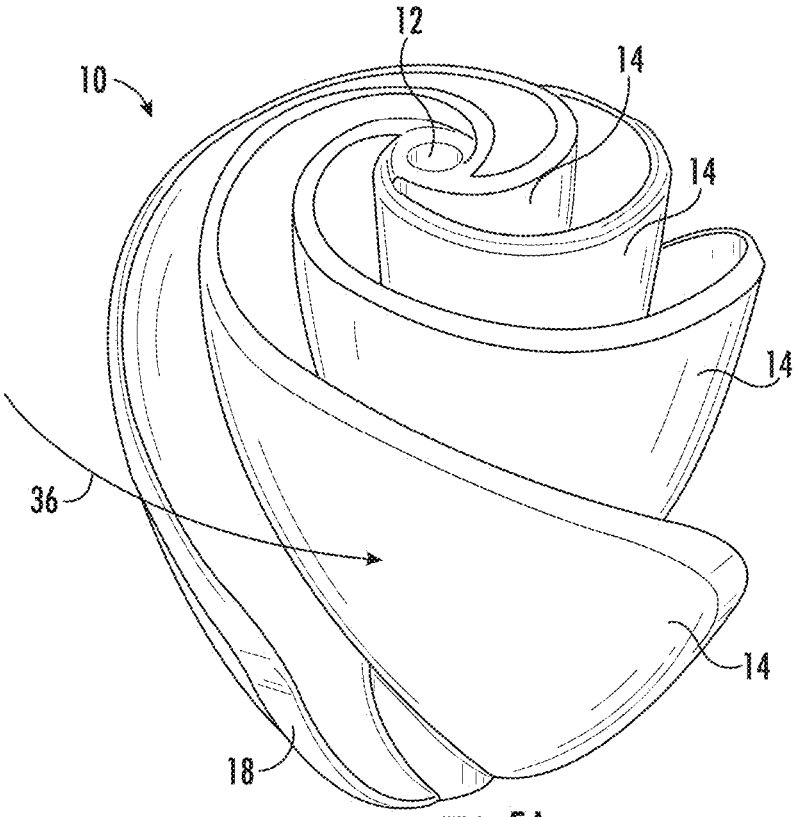
FIGS. 5A-5D depict a four blade embodiment of a fluid displacement, according to an exemplary embodiment.
Figure 5B:
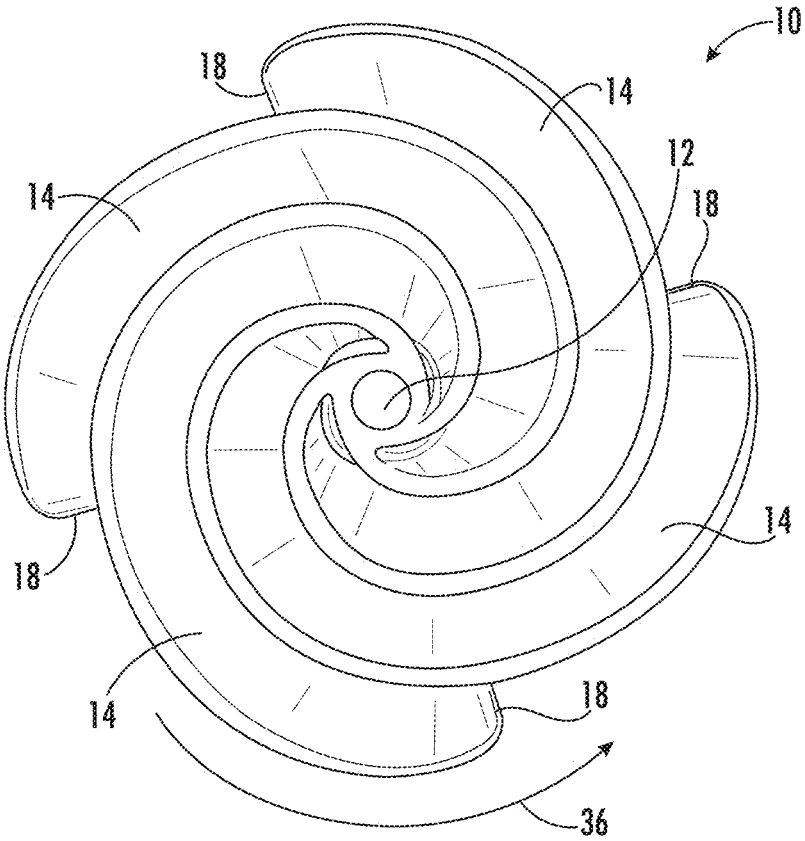
Figure 5C:
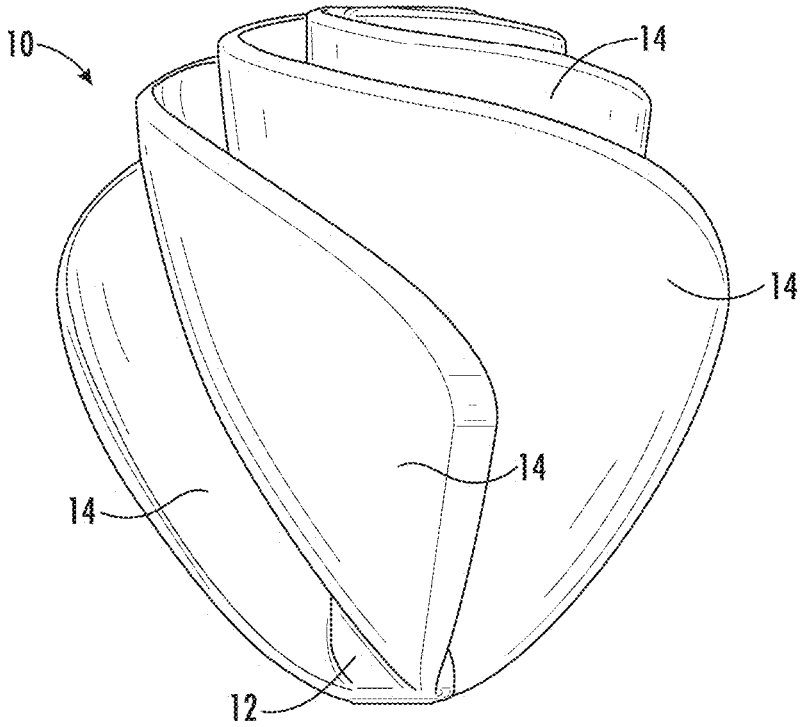
Figure 5D:
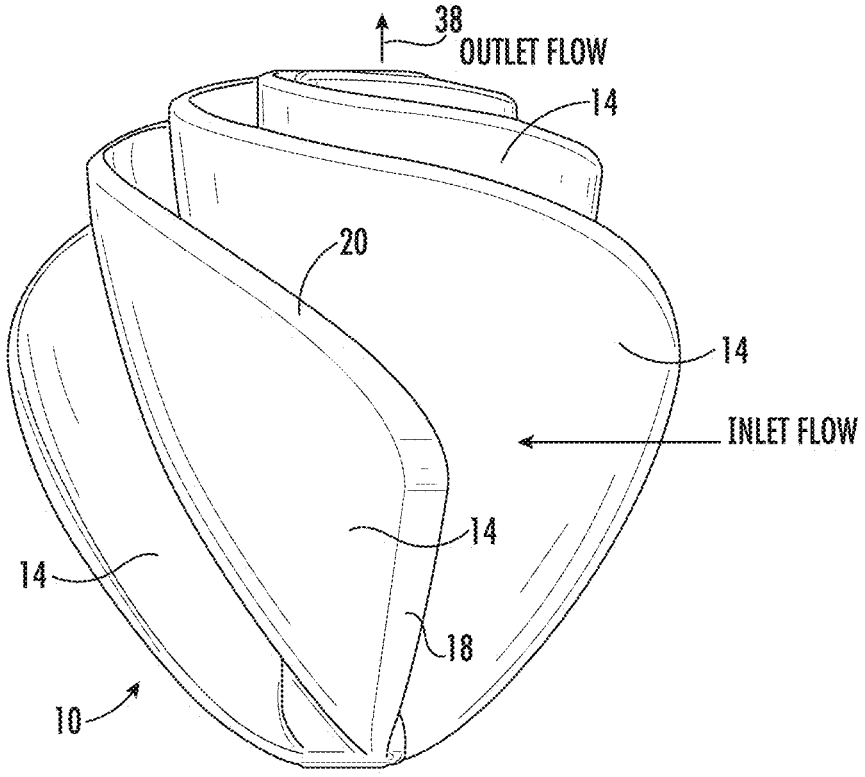

FIGS. 5A-5D depict a fluid displacement device 10 having four vanes 14. As shown in FIG. 5A, the fluid displacement device 10 is shown as rotating about the center shaft 12 in a direction of rotation 36. FIG. 5B depicts a top view of the fluid displacement device 10 of FIG. 5A. As can be seen in the embodiment of FIG. 5B, the outer edges 18 of the vanes 14 are equidistantly spaced around the center shaft 12. That is, the outer edges 18 are separated by about 90°. FIG. 5C depicts the profile view of the fluid displacement device 10, and FIG. 5D depicts fluid flow in relation to the fluid displacement device 10.

Figure 6A:
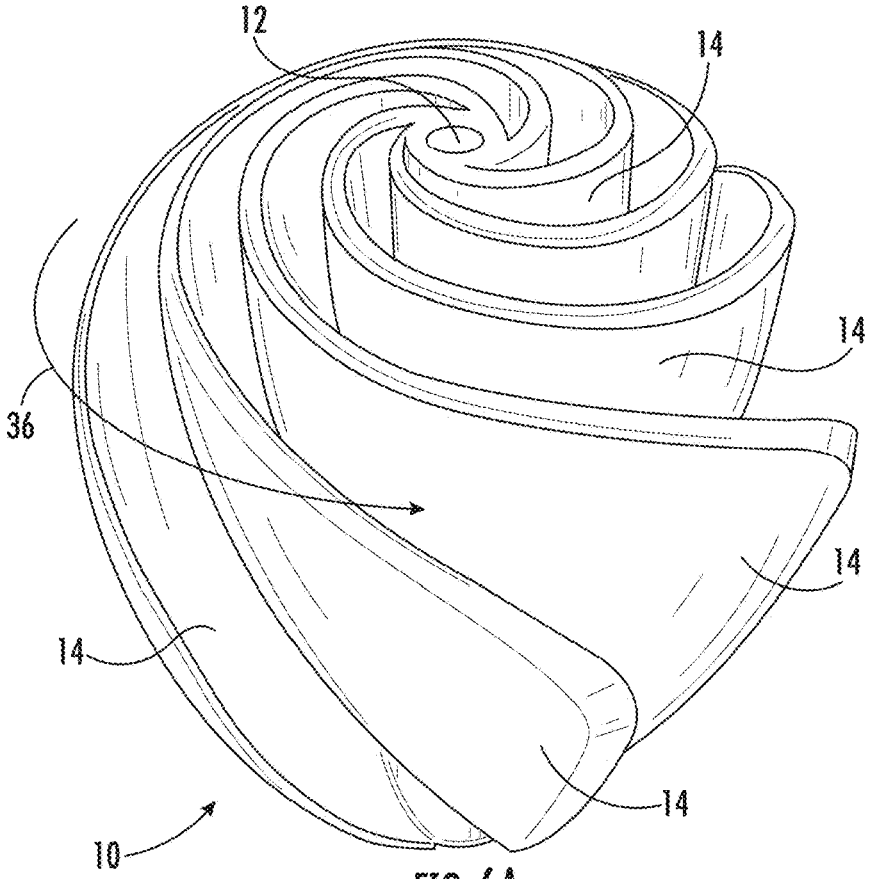
FIGS. 6A-6D depict a five blade embodiment of a fluid displacement device, according to an exemplary embodiment.
Figure 6B:
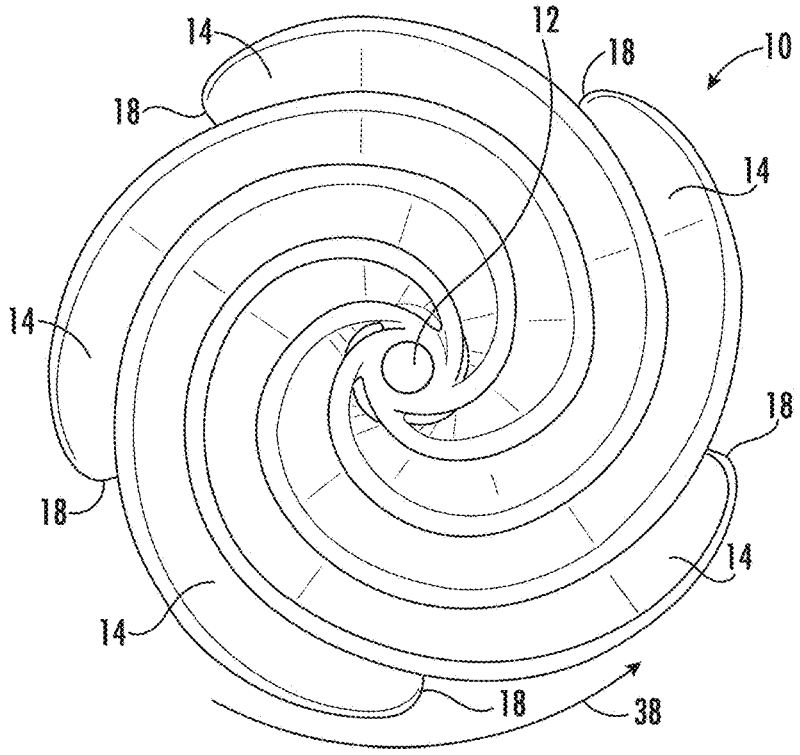
Figure 6C:
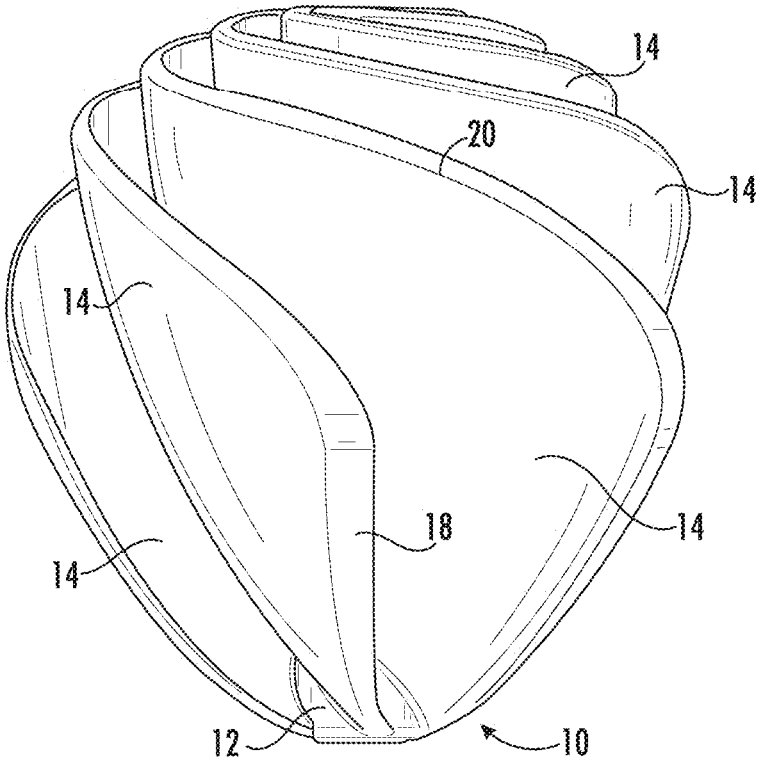
Figure 6D:
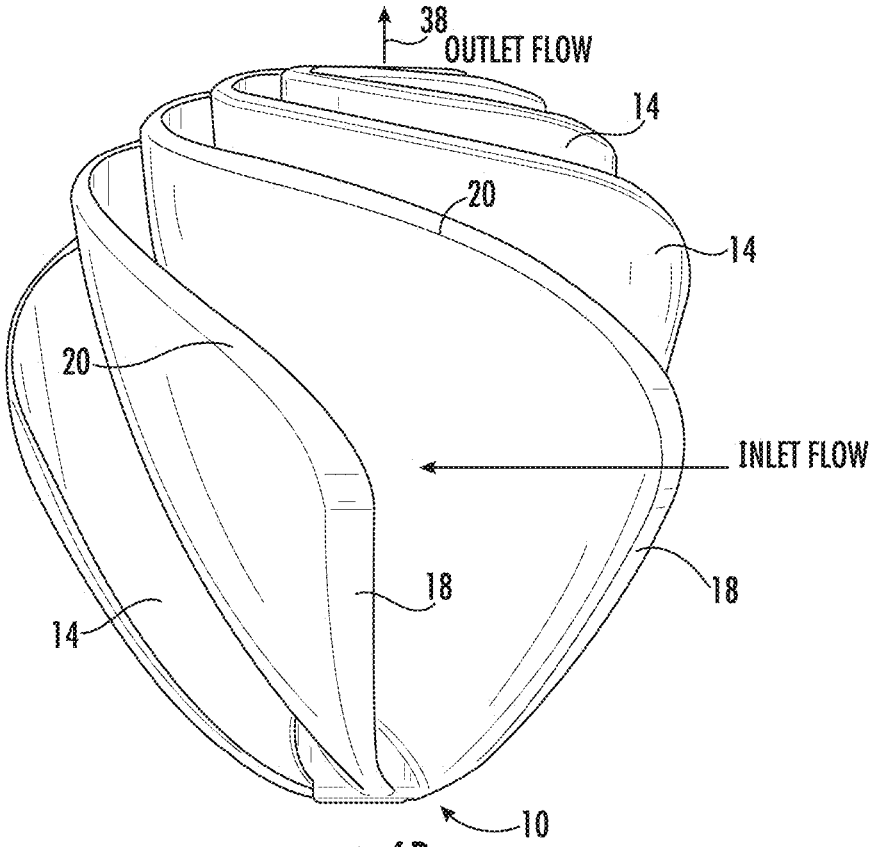

FIGS. 6A-6D depict a fluid displacement device 10 having five vanes 14. As shown in FIG. 6A, the fluid displacement device 10 is shown as rotating about the center shaft 12 in a direction of rotation 36. FIG. 6B depicts a top view of the fluid displacement device 10 of FIG. 6A. As can be seen in the embodiment of FIG. 6B, the outer edges 18 of the vanes 14 are equidistantly spaced around the center shaft 12. That is, the outer edges 18 are separated by about 72°. FIG. 6C depicts the profile view of the fluid displacement device 10, and FIG. 6D depicts fluid flow in relation to the fluid displacement device 10.

Figure 7:
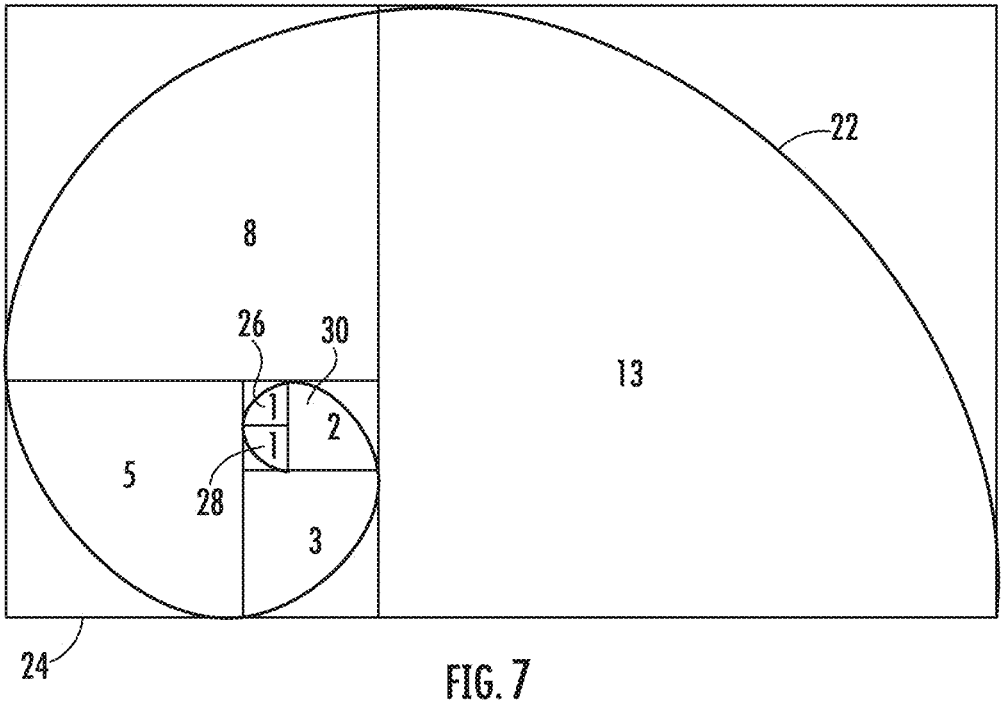
FIG. 7 depicts a Fibonacci spiral used in the design of the vanes of the fluid displacement device, according to an exemplary embodiment.
Figure 8A:
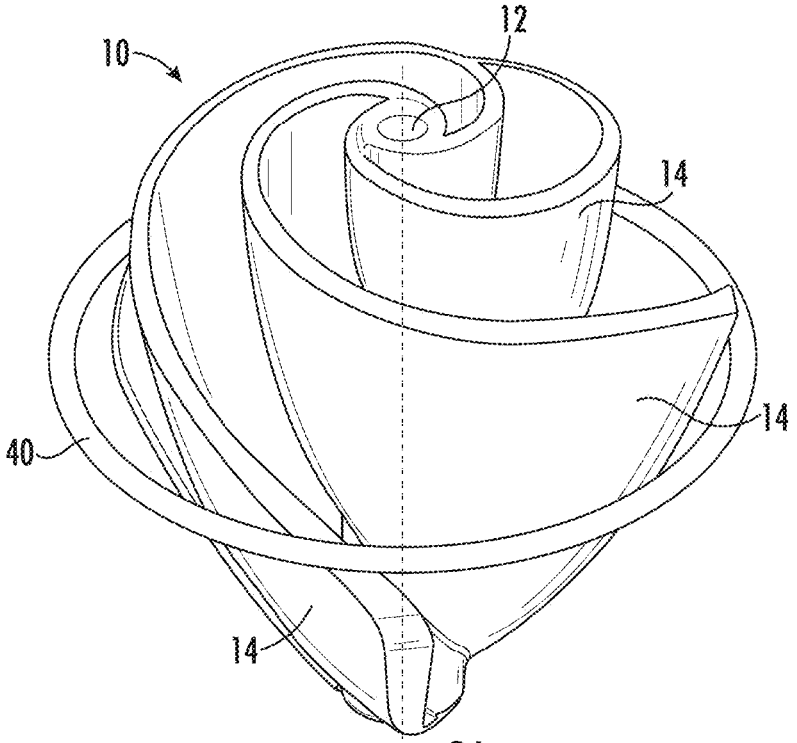
FIGS. 8A-8D depict an embodiment of a fluid displacement device having a retainer ring to stabilize the vanes of the fluid displacement device, according to an exemplary embodiment.
Figure 8B:
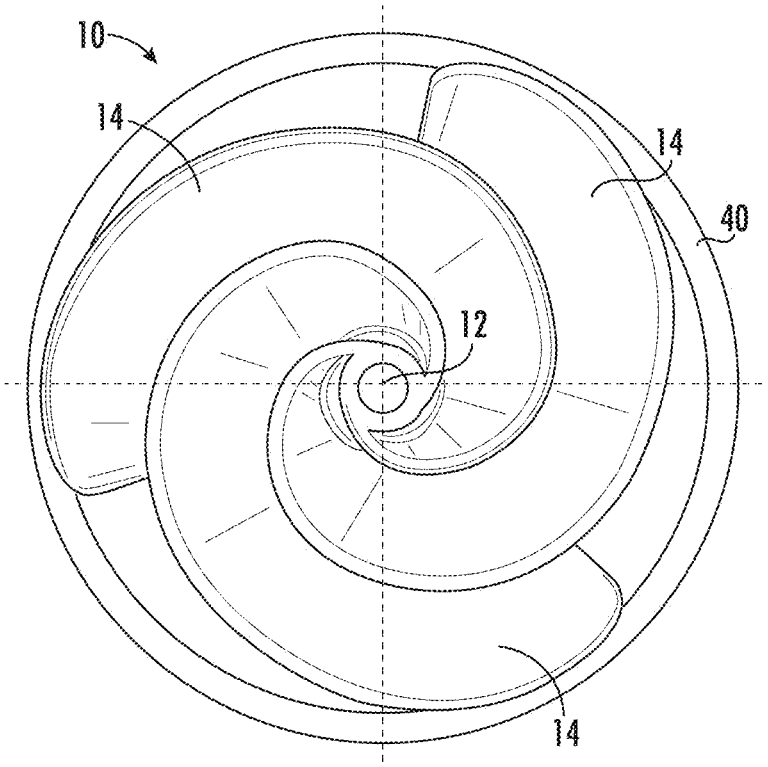
Figure 8C:
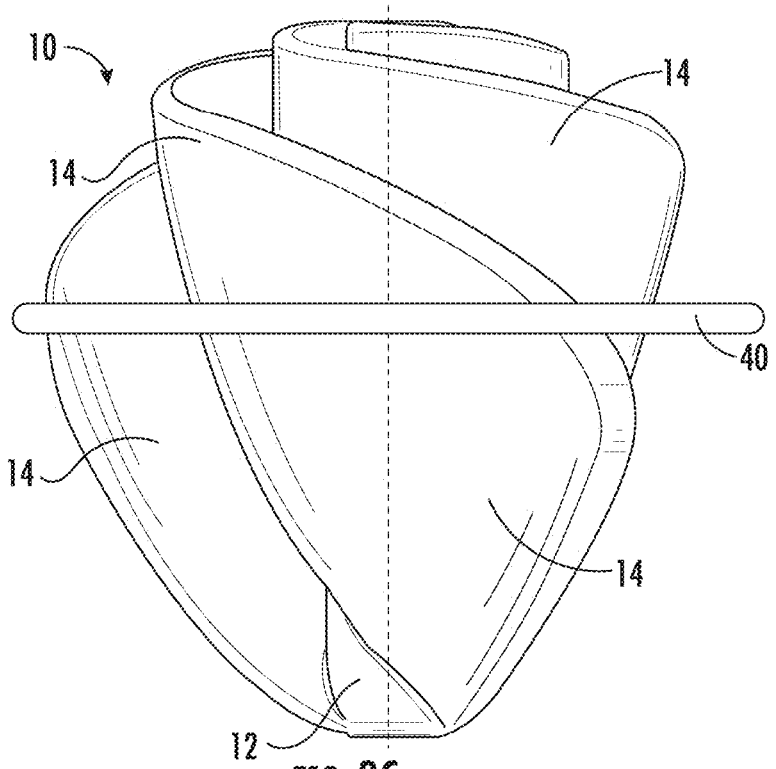
Figure 8D:
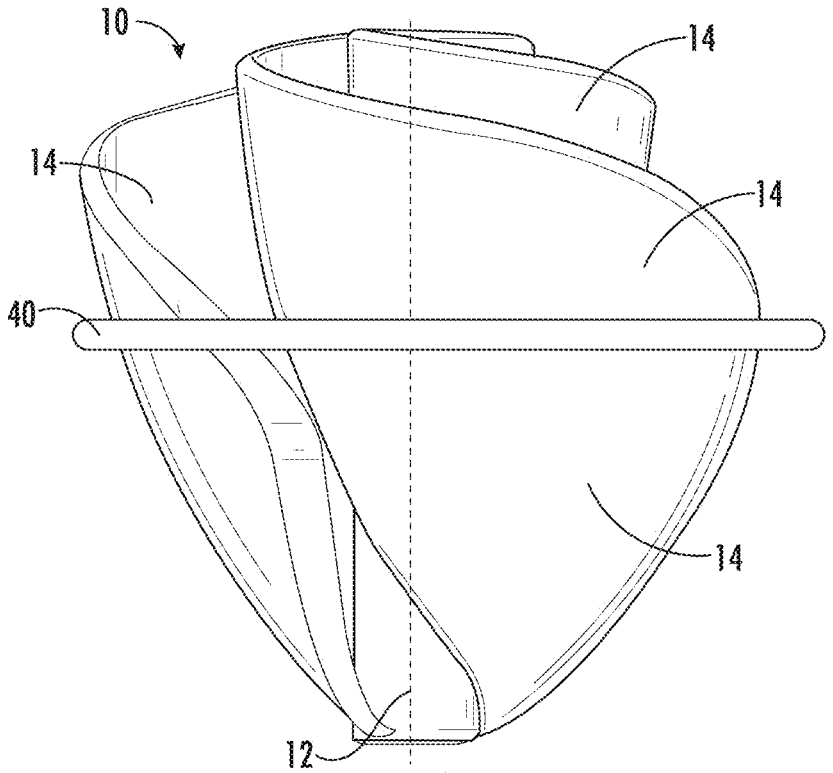

In the embodiments depicted, the spiraling edge 20 of the vanes 14 of the fluid displacement devices 10 have followed the Fibonacci spiral through at least five Fibonacci tiles and at least partially into a sixth Fibonacci tile. Thus, the spiraling edge 20 follows the Fibonacci sequence through at least 1, 1, 2, 3, and 5 as shown in FIG. 7 and at least partially through 8. In other embodiments, the spiraling edge 20 follows the Fibonacci spiral through six Fibonacci tiles and at least partially into a seventh Fibonacci tile. In such an embodiment, the spiraling edge 20 would follow the Fibonacci sequence through 1, 1, 2, 3, 5, 8 and at least partially through 13. Again, the units are relative based on the particular Fibonacci sequence used and the size of the fluid displacement device 10 needed for a particular application.

FIGS. 8A-8D depict another embodiment of the fluid displacement device 10 having a retaining ring 40. The retaining ring 40 enhances the structural integrity of the fluid displacement device 10. In certain applications, the fluid displacement device 10 may be operated at high speeds or displace heavy fluids, which may increase the stress on the vanes 14. The retaining ring 40 supports the vanes 14 in such circumstances. Additionally, the retaining ring 40 may be used to reinforce the structure of the fluid displacement device 10 so that lighter materials may be used for the vanes 14. In embodiments, the retaining ring 40 is joined to the vanes 14 using an adhesive or through welding. In other embodiments, the retaining ring 40 may be formed from the material of the fluid displacement device 10 such that the fluid displacement device 10 and retaining ring 40 are a unitary construction.

The uses of the fluid displacement device 10, including the exemplary embodiments described herein, are many and varied covering a wide variety of applications. In embodiments, the fluid displacement device 10 may be used to replace squirrel cage fans, axial flow through fans where space and installation constraints are a problem, or fans for heat exchange applications just to name a few. In embodiments, the fluid displacement device 10 can also be used as a turbine to generate electricity using, e.g., wind, water, or steam to spin the vanes 14. Further, in embodiments, the fluid displacement device 10 can be used to measure flow rate, such as by using the fluid displacement device 10 in a flow meter. As mentioned above, the fluid displacement device may also be used in a variety of contexts, such as an impeller, a propeller, an auger, or a mixer, among others. Further, depending on the particular use, the fluid displacement device 10 may be metal, plastic, composite, or ceramic.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A fluid displacement device, comprising:

a center shaft;

a plurality of vanes, each of the plurality of vanes having an inner edge, an outer edge, and a spiraling edge disposed between the inner edge and the outer edge;

wherein the spiraling edge of each of the plurality of vanes and the center shaft define a Fibonacci spiral through at least five successive Fibonacci numbers; and wherein the center shaft defines an axis, wherein the outer sides of each of the plurality of vanes define an arc of a vesica piscis that intersects the axis of the center shaft.

2. The fluid displacement device of claim 1, wherein the plurality of vanes comprises from two to five vanes.

3. The fluid displacement device of claim 1, wherein the outer edges of the plurality of vanes are substantially equidistantly spaced around the center shaft.

4. The fluid displacement device of claim 1, wherein the at least five successive Fibonacci numbers are 1, 1, 2, 3, 5.

5. The fluid displacement device of claim 1, wherein the center shaft has a first end and a second end defining a length of the center shaft therebetween, wherein the center shaft has a radius, and wherein the length is from 10 to 20 times the radius.

6. The fluid displacement device of claim 5, wherein the length is from 13 to 17 times the radius.

7. The fluid displacement device of claim 5, wherein the spiraling edge descends from the first end of the center shaft towards the second end of the center shaft to a position along the length of the center shaft that is from 30% to 70% of the length of the center shaft.

8. The fluid displacement device of claim 7, wherein the position along the length of the center shaft is from 40% to 60% of the length of the center shaft.

9. The fluid displacement device of claim 5, wherein the vesica piscis has a width that is perpendicular to the axis of the center shaft, wherein the width of the vesica piscis is from 12 to 22 times the radius of the center shaft.

10. The fluid displacement device of claim 9, wherein the width of the vesica picis is from 15 to 20 times the radius of the center shaft.

11. The fluid displacement device of claim 1, further comprising a reinforcing ring encircling the plurality of vanes.

12. The fluid displacement device of claim 1, wherein the center shaft is configured to rotate to spin the plurality of vanes and wherein the fluid displacement device is configured to redirect inlet fluid flow transverse to a longitudinal axis of the center shaft to outlet fluid flow substantially parallel to the longitudinal axis.

13. The fluid displacement device of claim 1, wherein the center shaft is stationary and wherein the fluid displacement device is configured to redirect inlet fluid flow entering the vanes from a direction parallel to a longitudinal axis of the center shaft to outlet fluid flow radially outward from the plurality of vanes.

14. The fluid displacement device of claim 1, wherein the plurality of vanes comprises two vanes having outer edges separated by 180°.

15. The fluid displacement device of claim 1, wherein the plurality of vanes comprises three vanes having outer edges that are separated by 120°.

16. The fluid displacement device of claim 1, wherein the plurality of vanes comprises four vanes having outer edges that are separated by 90°.

* * * * *